US008412074B2

(12) United States Patent
Shin et al.

(10) Patent No.: US 8,412,074 B2
(45) Date of Patent: Apr. 2, 2013

(54) CHARGING ROLLER FOR IMAGE FORMING APPARATUS AND MANUFACTURING METHOD THEREOF

(75) Inventors: Young-sub Shin, Hwaseong-si (KR); Jong-moon Eun, Seoul (KR); Hee-won Jung, Suwon-si (KR); Do-kwan Lee, Pohang-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 303 days.

(21) Appl. No.: 12/831,372

(22) Filed: Jul. 7, 2010

(65) Prior Publication Data

US 2011/0129258 A1 Jun. 2, 2011

(51) Int. Cl.
*G03G 15/02* (2006.01)

(52) U.S. Cl. ..... 399/176

(58) Field of Classification Search ..... 399/176, 399/303, 313; 361/221; 430/902
See application file for complete search history.

(56) References Cited

U.S. PATENT DOCUMENTS

| | | | | |
|---|---|---|---|---|
| 6,400,919 | B1 * | 6/2002 | Inoue et al. | 399/176 |
| 2004/0200317 | A1 * | 10/2004 | Naito et al. | 75/244 |
| 2005/0105935 | A1 * | 5/2005 | Schlafer et al. | 399/266 |
| 2007/0171597 | A1 * | 7/2007 | Merker et al. | 361/523 |
| 2010/0317788 | A1 * | 12/2010 | Schutyser et al. | 524/492 |

FOREIGN PATENT DOCUMENTS

JP 64-082331 A * 3/1989

* cited by examiner

*Primary Examiner* — Sophia S Chen
(74) *Attorney, Agent, or Firm* — Stanzione & Kim, LLP

(57) ABSTRACT

Disclosed is a charging roller for an image forming apparatus capable of preventing the formations of surface scratches. The charging roller includes a roller shaft, a roller body formed on the roller shaft and a scratch prevention layer formed on the roller body. The scratch prevention layer contains inorganic crystal of polysilicate.

13 Claims, 2 Drawing Sheets

CHARGING ROLLER FOR IMAGE FORMING APPARATUS AND MANUFACTURING METHOD THEREOF

CROSS-REFERENCE TO RELATED APPLICATIONS

This application claims priority under 35 U.S.C. §119 from Korean Patent Application No. 10-2009-117892, filed on Dec. 1, 2009, in the Korean Intellectual Property Office, the disclosure of which is incorporated herein by reference in its entirety.

BACKGROUND

1. Field of the Invention

The present disclosure relates generally to an image forming apparatus, and, more particularly, to a charging roller used in an image forming apparatus.

2. Description of the Related Art

An image forming apparatus such as, for example, a printer, a facsimile machine, a copier, and a multifunction peripheral, may employ an electro-photographic method of forming an image on a printing medium, e.g., on a sheet of paper. Such an electrophotographic image forming generally involves a charging process, a laser scanning process, a developing process, a transferring process and a fusing process in order to form the image. During the charging process, a charging roller is used to charge a photoconductor to a predetermined electrical potential. During the laser scanning process, a laser scanning unit irradiates light on the charged surface of the photoconductor to thereby form an electrostatic latent image on the photoconductor that corresponds to the desired image. In the developing process, a developing unit supplies developer such as, for example, toner, to the photoconductor so as to develop the electrostatic latent image to thereby form a developer image. In the transferring process, a transferring unit transfers the developer image formed on the photoconductor onto a printing medium. In the fusing process, a fusing unit fuses or melts the developer image onto the printing medium. The electrophotographic image forming is completed with the discharging of the printing medium bearing the fused developer image outside the image forming apparatus.

As the charging roller used in the charging process is driven in contact with the photoconductor, the surface of the charging roller may be subjected to a mechanical shock. In addition, the surface of the charging roller may be subjected to the friction from the toner, additives to toner and/or the developer. Over time, scratches may be formed on the surface of the charging roller, resulting in the inability of the charging roller to uniformly charge the photoconductor to the detriment of the quality of the resulting image.

As the extent of the physical shock that may be imparted on the surface of the charging roller may become greater with the increase in the printing speed, the likelihood of the formation of the scratches is generally higher in the case of high speed image forming apparatuses.

SUMMARY

According to one aspect of the present invention, there is provided a charging roller for use in an image forming apparatus that may include a roller shaft, a roller body formed on the roller shaft and a scratch prevention layer formed on the roller body. The scratch prevention layer may contain therein inorganic crystal of polysilicate.

The scratch prevention layer may be formed by heat-hardening a coating composition that comprises a silica sol and a coating auxiliary material.

The silica sol may be obtained by hydrolysis reaction between water and alkoxysilane dissolved in alcohol.

The alkoxysilane may be one or more compounds selected from the group consisting of tetraethoxysilane, alkyltriethoxysilane, tetramethoxysilane, tetrapropoxysilane and tetrabutoxysilane.

The alcohol may be one or more compounds selected from the group consisting of ethanol, methanol and 2-propanol.

The coating auxiliary material may comprise p-toluenesulfonic acid, n-methylpyrrolidone and hydroxypropylcellulose.

The scratch prevention layer may have a film hardness that is 6H pencil hardness or greater.

The roller body may have a multi-layer configuration comprising an inner layer and an outer layer.

According to another aspect of the present disclosure, an image forming apparatus may be provided to include a photoconductor, a charging roller, a laser scanning unit, a developing unit, a transferring unit and a fusing unit. The charging roller may be configured to charge the photoconductor to an electrical potential. The laser scanning unit may be configured to irradiate light on the photoconductor so as to thereby form an electrostatic latent image on the photoconductor. The developing unit may be configured to supply developer to the photoconductor so as to develop the electrostatic latent image into a developer image. The transferring unit may be configured to transfer the developer image from the photoconductor to a printing medium. The fusing unit may be configured to fuse the developer image onto the printing medium. The charging roller may comprise a roller shaft, a roller body formed on the roller shaft and a scratch prevention layer formed on the roller body. The scratch prevention layer may contain therein inorganic crystal of polysilicate.

According to yet another aspect of the present disclosure, a method of fabricating a charging roller useable in an image forming apparatus may be provided to include the steps of forming a roller body on a roller shaft and forming a scratch prevention layer, which may contain inorganic crystal of polysilicate, on the roller body. The forming of the scratch prevention layer may comprise preparing a coating composition that comprises a silica sol and a coating auxiliary material, coating the coating composition over the roller body and hardening the coating composition.

The silica sol may be obtained by hydrolysis reaction between water and alkoxysilane dissolved in alcohol.

The alkoxysilane may be one or more compounds selected from the group consisting of tetraethoxysilane, alkyltriethoxysilane, tetramethoxysilane, tetrapropoxysilane and tetrabutoxysilane.

The alcohol may be one or more compounds selected from the group consisting of ethanol, methanol and 2-propanol.

The coating auxiliary material may comprise p-toluenesulfonic acid, n-methylpyrrolidone and hydroxypropylcellulose.

The hardening of the coating composition may comprise heating the coating composition.

The hardening of the coating composition may comprise exposing the coating composition to UV rays.

The coating composition may comprise a resin base, a monomer, a photo initiator, a silicate reinforcing filler and an additive.

The resin base of the coating composition may be about 20-40 parts by weight for every 100 parts by weight of the coating composition.

The monomer of the coating composition may be about 5-20 parts by weight for every 100 parts by weight of the coating composition.

The silicate reinforcing filler of the coating composition may be about 10-50 parts by weight for every 100 parts by weight of the coating composition.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF THE EMBODIMENTS

Figure 1:
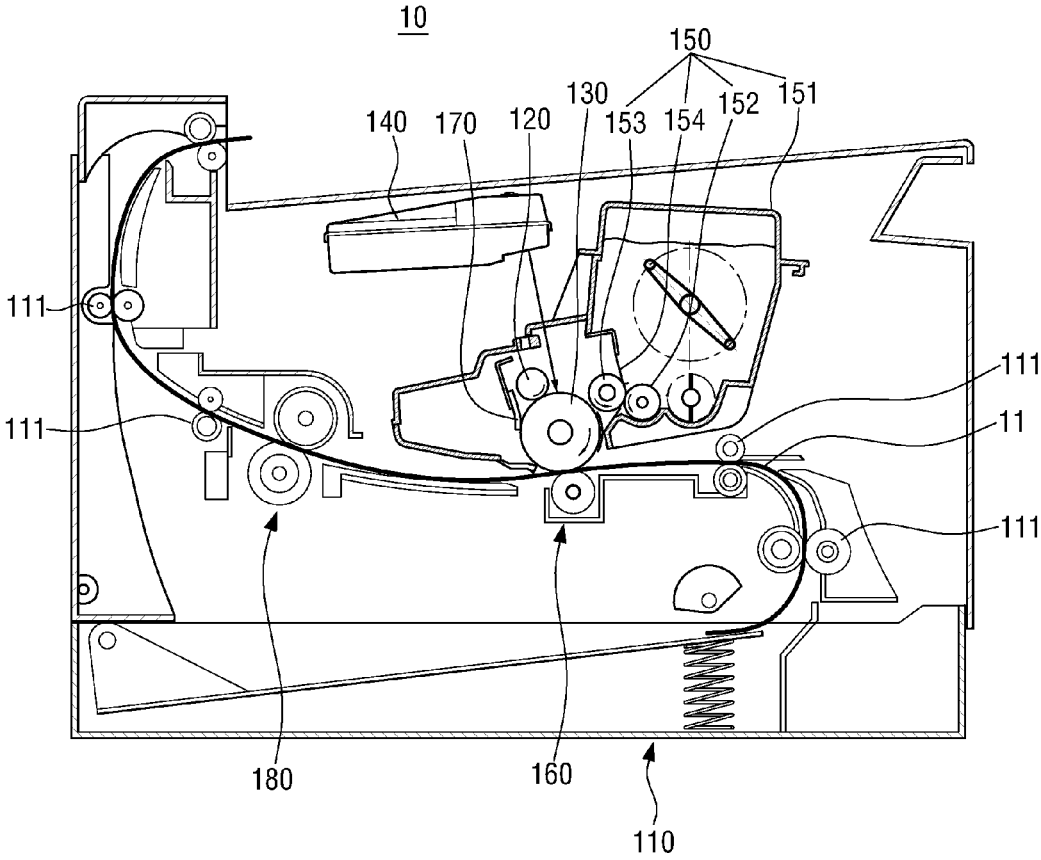
FIG. 1 is a schematic illustration of an image forming apparatus according to an embodiment of the present disclosure.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments may be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Illustrated schematically in FIG. 1 is an image forming apparatus 10 according to an embodiment of the present disclosure, which may be any of many diverse apparatuses capable of forming an image on a printing medium, such as, for example, a printer, a facsimile machine, a copier, a multifunction peripheral devices and the like. Reference numeral 11 of FIG. 1 indicates the path along which the printing medium advances in the image forming apparatus 10.

The image forming apparatus 10 according to an embodiment of the present disclosure may includes a paper feeding unit 110, a charging roller 120, a photoconductor 130, a laser scanning unit 140, a developing unit 150, a transferring unit 160, a cleaning unit 170 and a fusing unit 180.

The paper feeding unit 110 is capable of storing therein printing media such as, for example, sheets of paper. The printing medium is conveyed along the advancing path 11 by the conveyance rollers 111. The charging roller 120 charges the photoconductor 130 to an electrical potential. The laser scanning unit 140 irradiates light on the charged surface of the photoconductor 130 to thereby form thereon an electrostatic latent image corresponding to the printing data for the desired image to be formed.

The developing unit 150 supplies developer to the photoconductor 130 so as to visibly develop the electrostatic latent image into a developer image. The developing unit 150 may include a developer container 151, a developer supply roller 152 and a developing roller 153.

The developer container 151 contains the supply of developer. The developer supply roller 152 supplies the developer contained in the developer container 151 to the developing roller 153 such that a layer of developer is supported on the developing roller 153. A regulation blade 154 may be provided to regulate the developer layer to a uniform thickness. Select portions of the developer layer on the developing roller 153 move over to the photoconductor 130, thereby forming the developer image.

The transferring unit 160 is then used to transfer the developer image from the photoconductor 130 onto the printing medium. The cleaning unit 170 removes the developer that remain residual on the photoconductor 130 after the transferring process. The fusing unit 180 fuses the developer image onto the printing medium. The printing medium on which the developer image is fused is finally discharged outside the image forming apparatus 10 by the conveyance rollers 111.

Figure 2:
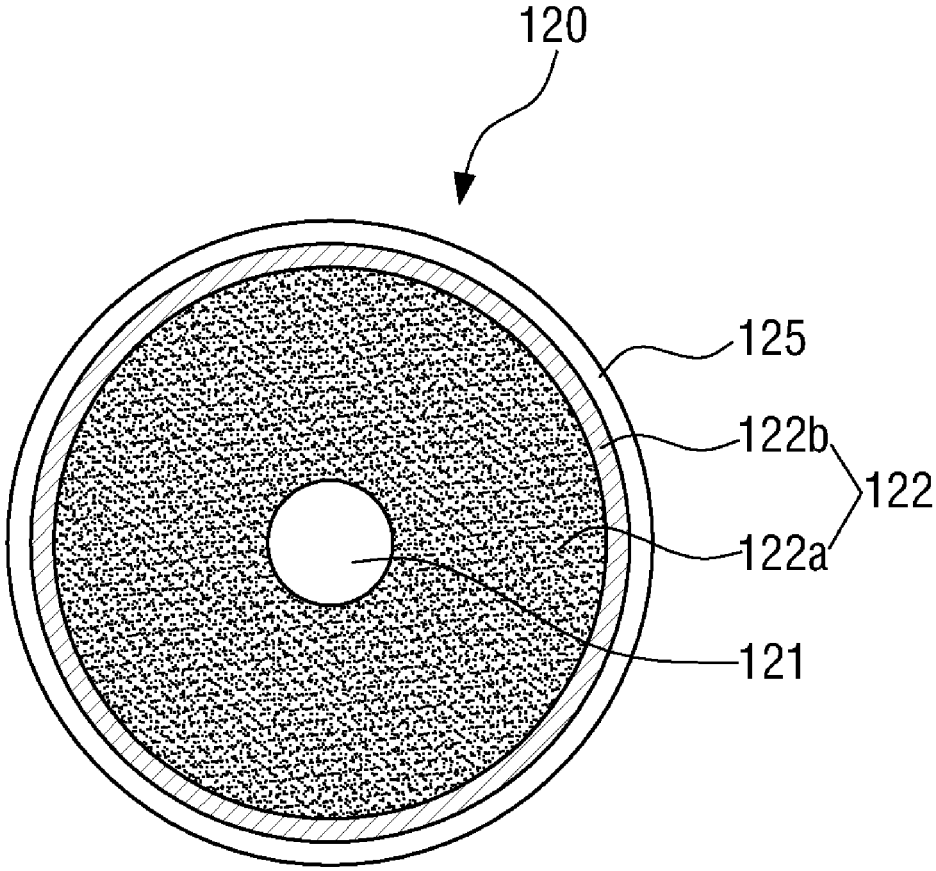
FIG. 2 is an enlarged view of the charging roller of FIG. 1.

FIG. 2 is an enlarged view of the charging roller 120 of FIG. 1, which according to an embodiment may include a roller shaft 121, a roller body 122 and a scratch prevention layer 125.

The roller shaft 121 may be made of a metallic material, and may be electrically conductive.

The roller body 122 may be formed on the roller shaft 121, and may be electrically conductive in order to charge the photoconductor 130. According to an embodiment of the present disclosure, the roller body 122 may have a multi-layer configuration including an inner layer 122*a* and an outer layer 122*b*.

The inner layer 122*a* may be made of an elastic material whereas the outer layer 122*b* may be provide to protect the inner layer 122*a*. When the charging roller 120 is used under an environment that subjects the same to high temperature and/or high humidity conditions, it is possible that some material constituting the inner layer 122*a* may migrate over to the photoconductor 130, thereby contaminating the photoconductor 130. The outer layer 122*b* may also serve the function of preventing such contamination of the photoconductor 130. The outer layer 122*b* may have the additional role of minimizing the aging effects on the resistance of the charging roller 120.

As a material for the inner layer 122*a*, ethylene propylene rubber (EPDM), acrylonitile butadiene rubber, chloroprene rubber (CR), epichlorohydrin rubber, silicon rubber, fluoro rubber, and polyurethane elastomer may be used, for example.

The outer layer 122*b* may be formed on the inner layer 122*a* by a melt extrusion or by coating, for example. When the outer layer 122*b* is formed by a melt extrusion, a plastic compound providing electrical conductivity may be obtained by dispersing, for example, carbon black, metal, conductive metal oxide, conductive polymer, or the like. Examples of the plastic that can be used may include polyethylene, polyproplylen, polyvinyl chloride, polyvinylidene chloride, polyamide, polyimide, polycarbonate, polystyrene, ABS, polyurethane, or NBR/ECO.

If the outer layer 122*b* is to be coated, a spraying or dipping process may be used with, for example, carbon black, metal, conductive metal oxide, conductive polymer, or the like dispersed into polyurethane.

In the example of FIG. 2, the roller body 122 is shown to have a multi-layered configuration. However, it should be understood that the roller body 122 may alternatively have a single layer configuration, and may be made of various material and manufacturing processes other than those specific examples given above.

As the charging roller 120 operates in contact with the photoconductor 130, the surface thereof may be subjected to a significant shock and/or vibration during operation. The surface of the charging roller 120 may receive additional stress from the friction with the toner, external additives to toner and the developer. Thus, scratches may form on the surface of the charging roller 120 over a period of use. The scratched surface of the charging roller 120 may cause the charging of the photoconductor 130 to be non-uniform, resulting in a poor image quality. The scratch prevention layer 125 according to an embodiment of the present disclosure may be formed on the roller body 122 so as to prevents such scratches from forming on the surface of the charging roller 120.

With the higher film hardness, the scratch prevention layer 125 is resistant to scratches from the shock and frictions, to which it may be subjected. The film hardness of the scratch prevention layer 125 according to an embodiment may be sufficiently high, for example, from 5H to 6H or more in terms of the pencil hardness. The scratch prevention layer 125 may allow the charging roller 120 to be usable for a longer period of time. Even with an increased level of shock and vibration in a higher speed printing operation, scratching of the charging roller 120 may be significantly reduced.

A method for manufacturing the charging roller 120 according to an embodiment of the present disclosure will be described in reference to an illustrative example.

Initially, the roller body 122 may be formed on the roller shaft 121. As the roller body 122 according to an embodiment has a multi-layered configuration that includes the inner layer 122*a* and the outer layer 122*b*, the respective processes for the manufacture of the inner layer 122*a* and the outer layer 122*b* will be described separately below.

A method for manufacturing the inner layer 122*a* according to an embodiment is as follows:

A reactive mixed liquid is made by agitating raw materials as listed in table 1 in a plastic container for two minutes and then vacuum-deaerating them.

TABLE 1

| | |
|---|---|
| Polyether polyol made by adding propylene oxide (PO) and ethylene oxide (EO) to glycerin (produced by Asahi Glass Co., Ltd, Ekusenol 828) | 100 phr |
| MDI(NCO = 23%)(produced by Sumimoto Bayer Urethane Co., Ltd., Sumidur PF) | 17.5 phr |
| Butanediol | 1.0 phr |
| Silicon surfactant | 1.5 phr |
| Conductive carbon | 1.0 phr |
| Conductive agent | 3.0 phr |

The term "phr" in Table 1 above is an abbreviation of "parts per hundred rubber," and indicates parts by weight of each component for every 100 parts by weight of rubber.

The inner layer 122*a* is formed by pouring the reactive mixed liquid into a mold of 100 mm×100 mm×2 mm and by heating and hardening at 150° C. for one minute.

A method for manufacturing the outer layer 122*b* is as follows:

The outer layer 122*b* is made by mixing a mono liquid type major material, to which polyol, isocyanates, and conductive agent (for example, tin oxide) are added, with a mono liquid type auxiliary material containing a melamine resin as a main component, by coating the inner layer 122*a* with the mixture, and by hardening the mixture at 150° C. for 4 hours.

As described above, the scratch prevention layer 125 is formed on the roller body 122 after the roller body 122 is formed on the roller shaft 121.

The scratch prevention layer 125 may be formed using a heat hardening process or an ultraviolet (UV) hardening process. A case where a heat hardening process is applied will be described first, followed by the description of a case where a UV hardening process is applied.

In order to use a heat hardening process, a coating composition including a silica sol and a coating auxiliary material is prepared.

The silica sol may be made by hydrolysis reaction between water and alkoxysilane which is dissolved in alcohol. The alcohol may be, for example, one or more compounds selected from the group consisting of ethanol, methanol, and 2-propanol. The alkoxysilane may be, for example, one or more compounds selected from the group consisting of tetraethoxysilane (TEOS), alkyltriethoxysilane, tetramethoxysilane, tetrapropoxysilane, and tetrabutoxysilane.

The coating auxiliary material improves coating performance and helps the formation of the scratch prevention layer 125. The coating auxiliary material may include, for example, p-toluenesulfonic acid (p-TSA), n-methylpyrrolidone (NMP), and hydroxypropylcellulose (HPC).

It should be noted that the specific materials mentioned above in relation to the alkoxysilane, alcohol, and to coating auxiliary material, are intended to be merely non-limiting examples, and that it should be understood that any material that can perform the same function as the aforementioned materials may also be used.

After the preparation of the coating composition, the coating composition is coated over the roller body 122.

The coating composition coated over the roller body 122 is then heat-hardened to form the scratch prevention layer 125 as shown in FIG. 2.

If the scratch prevention layer 125 is produced as described above, inorganic crystal of polysilicate is formed in the scratch prevention layer 125. Due to the inorganic crystal of polysilicate, the film hardness is improved so as to prevent the formation of scratches on the surface of the charging roller 120.

Several examples, in which tetraethoxysilane (TEOS) is used as alkoxysilane, methanol being used as alcohol, and in which p-TSA, NMP and HPC are used as the coating auxiliary material, will be described.

Table 2 shows the composition ratios of the coating composition used in these examples.

TABLE 2

| | Water | TEOS | Methanol | p-TSA | NMP | HPC |
|---|---|---|---|---|---|---|
| Case 1 | 10 | 3 | 85.98 | 0.01 | 1 | 0.01 |
| Case 2 | 6 | 3 | 88.96 | 0.02 | 2 | 0.02 |
| Case 3 | 2 | 1 | 90.90 | 0.05 | 6 | 0.05 |

The comparison results obtained from the scratch prevention layer 125 formed with the coating composition of Table 2 is shown in Table 3. In the Comparison Example 1 in Table 3, both the inner layer 122*a* and the outer layer 122*b* of the roller body 122 are formed of urethane, and the scratch prevention layer 125 is not provided. In the Comparison Example 2, the inner layer 122*a* of the roller body 122 is formed of urethane while the outer layer 122*b* is formed of ECO, and the scratch prevention layer 125 is not provided.

TABLE 3

| | Resistance | Film Hardness | Film Uniformity |
|---|---|---|---|
| Case 1 | 3.0E+5Ω | 9H | Good |
| Case 2 | 5.0E+5Ω | 7H | Good |
| Case 3 | 7.0E+5Ω | 6H | Good |
| Comparison Example 1 | 3.0E+5Ω | 2H | Good |
| Comparison Example 2 | 7.0E+5Ω | 3H | Good |

In Table 3, the resistance is measured by applying a voltage of −500V. The resistance of the charging roller 120 should be in a range suitable for use in an image forming apparatus. The above results of Table 3 shows that all examples, i.e., Cases 1-3, have resistance falling within an acceptable range.

In Table 3, the film hardness is measured under a load of 500 g using a pencil hardness tester, using a pencil manufactured by Mitsubishi. The bottom surface of the pencil is evenly ground and the pencil is inclined at 45° with respect to the surface of the charging roller 120. In contrast to the Comparison Examples 1 and 2, in each of which the scratch prevention layer 125 is not provided, each of example Cases 1-3 has a film hardness of 6H or more. This is believed because the inorganic crystal of polysilicate is formed on the scratch prevention layer 125 according to an aspect of the present disclosure.

In Table 3, the film uniformity is examined through the naked eyes. All Cases 1-3 have been observed to have good uniformity.

A further testing was conducted to determine whether a scratch is formed on the charging roller after printing of 30,000 or more sheets of printing media using the charging roller. In Cases 1-3, no scratch on the charging roller, nor any noticeable degradation of the image quality is observed even after printing of 30,000 or more sheets. However, in the Comparison Example 1, a severe scratching of the charging roller is observed while, in Comparison Example 2, a somewhat less severe scratching of the charging roller is observed, resulting in the corresponding image quality degradations.

Hereinafter, a method for forming the scratch prevention layer 125 using an UV hardening process will be described.

A coating composition is first prepared. The coating composition may include a resin base, a monomer, a photo initiator, a silicate reinforcing filler and an additive.

The resin base may be, for example, a mixture of epoxy acrylate and urethane acrylate. However, any material capable of similarly behaving may be used in lieu of or in addition to epoxy acrylate and urethane acrylate. According to an embodiment, the resin base may be 20-40 parts by weight for every 100 parts by weight of the coating composition. If the resin base is below 20 parts by weight, it may shrink excessively during the UV hardening process, thus resulting in the formation of wrinkles. If, on the other hand, the resin base is above 40 parts by weight, insufficient hardening may take place during the UV hardening process, thus resulting in a reduced hardness.

The monomer may be, for example, one or more compounds selected from the group consisting of a mono-functional monomer, a bi-functional monomer, and a tri-functional monomer. For example, the bi-functional monomer may be tripropylene glycol diacrylate while the tri-functional monomer may be trimethylpropane acrylate. However, it should be understood that any other monomer may be used. According to an embodiment, the monomer may be 5-20 parts by weight for every 100 parts by weight of the coating composition. If the monomer is below 5 parts by weight, hardening during the UV hardening process may be insufficient. If the monomer is above 20 parts by weight, on the other hand, cracks may develop due to an abrupt hardening.

According to an embodiment, the photo initiator may be 3-10 parts by weight for every 100 parts by weight of the coating composition. If the photo initiator is below 3 parts by weight, the UV hardening may result in an insufficient hardness. If the photo initiator is above 10 parts by weight, cracks may develop due to an abrupt hardening.

According to an embodiment, the silicate reinforcing filler may be 10-50 parts by weight for every 100 parts by weight of the coating composition. If the silicate reinforcing filler is below 10 parts by weight, the hardness may be reduced. If the silicate reinforcing filler is above 50 parts by weight, the silicate reinforcing filler may not be uniformly distributed in the resin base, thus also resulting in the hardness being reduced.

The additive may be added to provide conductivity, and/or to reduce formation of bubbles. The additive may be 0-10 parts by weight for every 100 parts by weight of the coating composition. The use of an excessive amount of additive can lead to the deterioration in other physical properties.

The coating composition prepared as described above is coated over the roller body 122. Then, UV rays are irradiated to the coating composition coated over the roller body 122, thereby hardening the coating composition. The UV rays may be irradiated using, for example, a mercury lamp having a wavelength of 200-400 mm for the duration of, for example, 3-30 seconds.

Through the above-described process, the scratch prevention layer 125 may be formed as shown in FIG. 2. Since the resin base and the monomer are cross-linked with each other, the film hardness of the scratch prevention layer 125 can be improved to prevent scratches from forming on the surface of the charging roller 120.

Hereinafter, an empirical measurement results of an example to which an UV hardening process is applied will be described.

Table 4 below shows the composition ratio of the coating composition in the example used for the measurements.

TABLE 4

| | | |
|---|---|---|
| Resin base | epoxy acrylate | 10 |
| | urethane acrylate | 25 |
| Monomer | trimethylpropane acrylate | 10 |
| | tripropylene glycol diacrylate | 10 |
| Photo initiator | | 5 |
| Additive | | 10 |
| Silicate reinforcing filler | | 30 |

The test results obtained from the scratch prevention layer 125 formed using the coating composition of the above ratio is shown in Table 5 below. In Table 5, Case 4 corresponds to an example in which the UV hardening process is performed for 3 seconds; Case 5 corresponds to another example in which the UV hardening process is performed for 5 seconds; and Case 6 corresponds to yet another example in which the UV hardening process is performed for 10 seconds. Each of the Comparison Examples 1 and 2 are as previously described, and does not include the scratch prevention layer 125.

TABLE 5

| | Resistance | Film Hardness | Film Uniformity |
|---|---|---|---|
| Case 4 | 4.0E+5Ω | 6H | Good |
| Case 5 | 9.0E+5Ω | 7H | Good |
| Case 6 | 5.0E+5Ω | 5H | Good |
| Comparison Example 1 | 3.0E+5Ω | 2H | Good |
| Comparison Example 2 | 7.0E+5Ω | 3H | Good |

As can be seen from Table 5, each of the Cases 4-6 has a resistance falling within an acceptable range. In comparison to the Comparison Examples 1 and 2, in each of which the scratch prevention layer 125 is not provided, each of the Cases 4-6 has a film hardness of 5H or more. Each of the Cases 4-6 also has good film uniformity.

Further, in each of the Cases 4-6, no scratches on the charging roller, nor any noticeable degradation of the image quality, were observed even after printing of 30,000 or more sheets.

While in the above description, the scratch prevention layer 125 is described as being formed on the charging roller 120, the image forming apparatus 10 may employ diverse other rollers such as, for example, the conveyance rollers 111 and the developing roller 153 in addition to the charging roller 120, and these other rollers may be susceptible to being scratched. Accordingly, it should be understood that aspects of the present disclosure may be applicable to a diversity of other rollers in addition to the charging roller 120.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A charging roller for use in an image forming apparatus, comprising:
- a roller shaft;
- a roller body formed on the roller shaft; and
- a scratch prevention layer formed on the roller body, wherein the scratch prevention layer contains therein inorganic crystal of polysilicate,
- wherein the scratch prevention layer has a film hardness that is 6H pencil hardness or greater.

2. The charging roller of claim 1, wherein the scratch prevention layer is formed by heat-hardening a coating composition that comprises the silica sol and the coating auxiliary material.

3. The charging roller of claim 2, wherein the silica sol is obtained by hydrolysis reaction between water and alkoxysilane dissolved in alcohol.

4. The charging roller of claim 3, wherein the alkoxysilane is one or more compounds selected from the group consisting of tetraethoxysilane, alkyltriethoxysilane, tetramethoxysilane, tetrapropoxysilane and tetrabutoxysilane.

5. The charging roller of claim 3, wherein the alcohol is one or more compounds selected from the group consisting of ethanol, methanol and 2-propanol.

6. The charging roller of claim 2, wherein the coating auxiliary material comprises p-toluenesulfonic acid, n-methylpyrrolidone and hydroxypropylcellulose.

7. The charging roller of claim 1, wherein the roller body has a multi-layer configuration comprising an inner layer and an outer layer.

8. An image forming apparatus, comprising:
- a photoconductor;
- a charging roller configured to charge the photoconductor to an electrical potential;
- a laser scanning unit configured to irradiate light on the photoconductor so as to thereby form an electrostatic latent image on the photoconductor;
- a developing unit configured to supply developer to the photoconductor so as to develop the electrostatic latent image into a developer image;
- a transferring unit configured to transfer the developer image from the photoconductor to a printing medium; and
- a fusing unit configured to fuse the developer image onto the printing medium,
- wherein the charging roller comprises:
  - a roller shaft;
  - a roller body formed on the roller shaft; and
  - a scratch prevention layer formed on the roller body, wherein the scratch prevention layer contains therein inorganic crystal of polysilicate,
- wherein the scratch prevention layer has a film hardness that is 6H pencil hardness or greater.

9. A method of fabricating a charging roller useable in an image forming apparatus, comprising:
- forming a roller body on a roller shaft; and
- forming a scratch prevention layer, which contains inorganic crystal of polysilicate, on the roller body,
- wherein the forming of the scratch prevention layer comprises:
  - preparing a coating composition that comprises a silica sol and a coating auxiliary material;
  - coating the coating composition over the roller body; and
  - heat-hardening the coating composition,
- wherein the scratch prevention layer has a film hardness that is 6H pencil hardness or greater.

10. The method of claim 9, wherein the silica sol is obtained by hydrolysis reaction between water and alkoxysilane dissolved in alcohol.

11. The method of claim 10, wherein the alkoxysilane is one or more compounds selected from the group consisting of tetraethoxysilane, alkyltriethoxysilane, tetramethoxysilane, tetrapropoxysilane and tetrabutoxysilane.

12. The method of claim 10, wherein the alcohol is one or more compounds selected from the group consisting of ethanol, methanol and 2-propanol.

13. The method of claim 10, wherein the coating auxiliary material comprises p-toluenesulfonic acid, n-methylpyrrolidone and hydroxypropylcellulose.

* * * * *